US009493942B2

(12) United States Patent
Martin et al.

(10) Patent No.: US 9,493,942 B2
(45) Date of Patent: Nov. 15, 2016

(54) PROTECTIVE MEMBRANE AND METHOD OF MANUFACTURING SAME

(71) Applicant: S.A. Imperbel N.V., Lot (BE)

(72) Inventors: Caroline Martin, Perwez (BE); Hans Aerts, Lot (BE); Eric Bertrand, Perwez (BE)

(73) Assignee: S.A. Imperbel N.V., Lot (BE)

( * ) Notice: Subject to any disclaimer, the term of this patent is extended or adjusted under 35 U.S.C. 154(b) by 0 days.

(21) Appl. No.: 13/778,239

(22) Filed: Feb. 27, 2013

(65) Prior Publication Data

US 2014/0072765 A1 Mar. 13, 2014

(30) Foreign Application Priority Data

Feb. 28, 2012 (EP) ..... 12157383

(51) Int. Cl.

| | |
|---|---|
| ***E04B 1/64*** | (2006.01) |
| ***E04D 5/12*** | (2006.01) |
| ***D06N 5/00*** | (2006.01) |
| ***E04B 1/84*** | (2006.01) |

(52) U.S. Cl.

CPC ..... *E04B 1/64* (2013.01); *D06N 5/003* (2013.01); *E04B 1/8409* (2013.01); *E04D 5/12* (2013.01); *Y10T 428/24397* (2015.01)

(58) Field of Classification Search

CPC ..... B32B 27/00; C08L 95/00; C08L 2666/02; A01N 25/34; A01N 2300/00; C07C 59/105; B27J 5/00; D06N 3/02; D06N 5/00; D06N 7/0028; D06N 5/003; E04D 1/26; E04D 1/28; E04D 2001/005; E04D 3/35; E04D 5/12; Y10T 428/24355; Y10T 428/24372; Y10T 428/24397; E04B 1/64; E04B 1/8409

USPC ..... 428/317.3, 17, 220, 221, 292.1, 314.8, 428/323, 325, 338, 343, 404, 407, 413, 428/42.1, 450, 516, 517, 519, 521, 428/141–150; 508/563, 133, 583, 591, 166, 508/272, 433, 459, 461, 463, 569, 110, 322, 508/330, 331, 345, 346, 419, 421, 509, 518

See application file for complete search history.

(56) References Cited

U.S. PATENT DOCUMENTS

| | | | | | |
|---|---|---|---|---|---|
| 1,905,827 | A | * | 4/1933 | Ellis | 442/104 |
| 2,563,115 | A | | 8/1951 | Huggins | |
| 3,276,906 | A | * | 10/1966 | Nielsen | 427/385.5 |
| 3,607,513 | A | * | 9/1971 | Samson | 156/181 |
| 3,814,731 | A | * | 6/1974 | Marwitz et al. | 528/31 |
| 3,937,640 | A | * | 2/1976 | Tajima et al. | 156/71 |
| 7,482,398 | B2 | * | 1/2009 | Bauer et al. | 524/126 |
| 2001/0036558 | A1 | * | 11/2001 | Lewtas et al. | 428/521 |

FOREIGN PATENT DOCUMENTS

| | | | | | |
|---|---|---|---|---|---|
| DE | 22 01 048 | | | 5/1973 | |
| DE | 25 04 857 | | | 8/1975 | |
| DE | 29 30 895 | | | 2/1981 | |
| GB | 157217 | A | * | 3/1922 | B61D 39/00 |
| GB | 923635 | | * | 4/1963 | E04D 5/12 |

* cited by examiner

*Primary Examiner* — Nathan Van Sell
(74) *Attorney, Agent, or Firm* — Jacobson Holman PLLC

(57) ABSTRACT

Protective membrane, in particular a waterproofing or noise insulation membrane, based on mineral or vegetable bitumen, comprising a membrane body, and a first and second surface situated on either side of said membrane body, where the first surface comprises cork particles, characterised in that said particles have a granulometry of between 0.5 and 3 mm, preferably between 1 and 3 mm, and have been heat treated with steam.

9 Claims, 1 Drawing Sheet

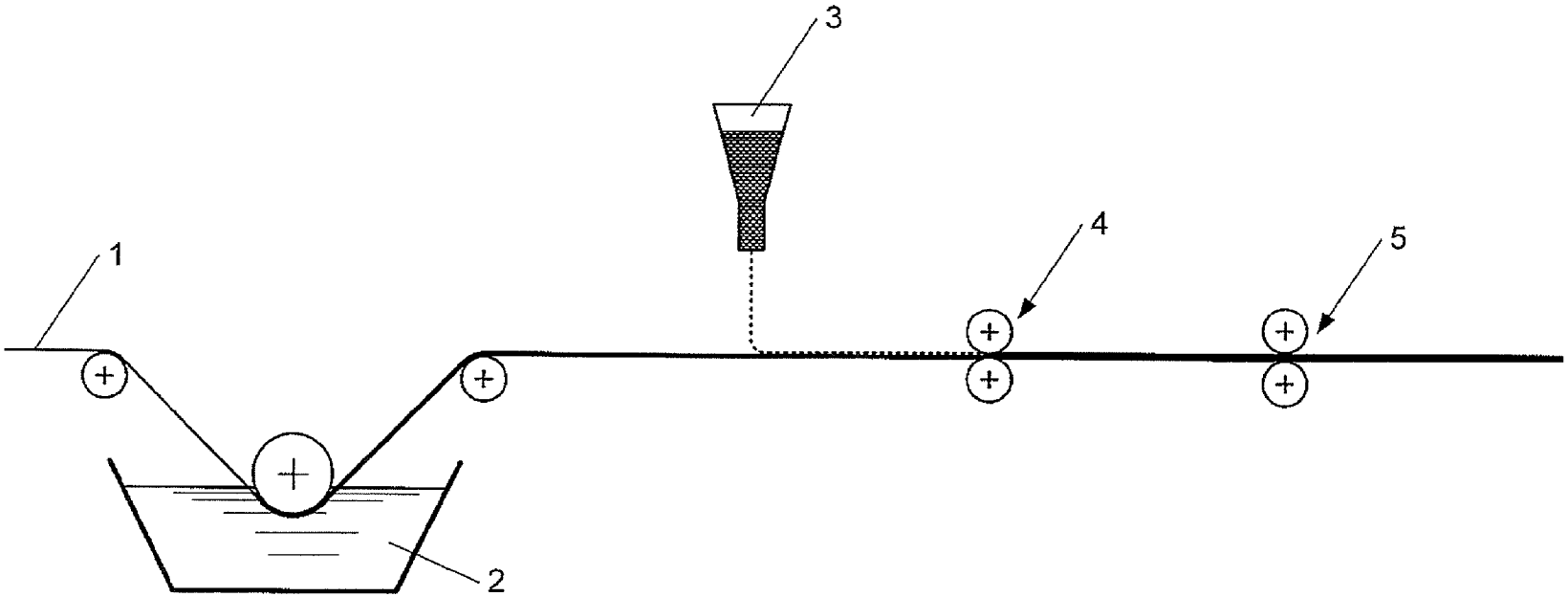
1
2
3
4
5

PROTECTIVE MEMBRANE AND METHOD OF MANUFACTURING SAME

The present invention relates to a protective membrane, in particular a waterproofing or noise insulation membrane based on mineral or vegetable bitumen, comprising a membrane body, and a first and second surface situated on either side of said membrane body, where the first surface comprises cork particles.

The present invention also relates to a method for manufacturing a protective membrane.

A noise insulation membrane comprising cork particles on the first surface is known. In the known membrane, the cork particles have a granulometry greater than 5 mm. This noise insulation membrane is intended to be applied under a ground covering.

One disadvantage of such an insulation membrane is with regard to its surface since it is rough. In addition, this type of insulation membrane cannot be used to protect the roof of a building for example, for several reasons.

First, the first surface of such a membrane is not smooth since it has surface irregularities. This is because the cork particles, which have a granulometry greater than 5 mm, are visible on the surface. Consequently said particles risk being torn away during bad weather for example. This insulation membrane is therefore not durable or able to be used for a roof.

Next, the cork particles have a granulometry greater than 5 mm and this results in the surface coverage of said cork particles being insufficient. This leads to the obtaining of a membrane with cork particles that cover only part of the bituminous mass. Part of the bituminous binder is then exposed to the surrounding environment. Having recourse to cork particles greater than 5 mm thus prevents the formation of a protective membrane comprising a first surface that is uniformly covered and smooth. Note that, if the bituminous binder is physically accessible, it may constitute a risk of ignition during a fire for example. This type of membrane therefore does not sufficiently resist fire and is therefore not suitable for being used on a roof.

Finally, the cork particles present on the first surface are liable to absorb water easily because of the porosity of cork. The absorption of water by said cork particles leads to the formation of microorganisms or algae on the surface of the insulation membrane.

Let us add that it is preferable to have recourse to a protective membrane with an aesthetic surface appearance when it is applied to building roofs for example. However, it is found that this is not the case with a membrane that comprises cork particles greater than 5 mm since these are visible to the naked eye.

The aim of the invention is to overcome the drawbacks of the prior art by procuring a protective membrane, in particular a waterproofing or noise insulation membrane, that resists the tearing away of the cork particles during bad weather for example, guarantees sufficient fire resistance and is aesthetically attractive.

To solve this problem, a protective membrane, in particular a waterproofing or noise insulation membrane according to the invention comprising cork particles on the first surface, is characterised in that said cork particles have a granulometry of between 0.5 and 3 mm, preferably between 1 and 3 mm, and have been heat-treated by steam.

The selection of a granulometric range makes it possible to obtain a protective membrane, the first surface of which is uniformly covered with cork particles. The choice of a granulometric range makes it possible concretely to have recourse to a particulate mixture capable of uniformly covering the first surface of the protective membrane when the cork particles are distributed. This is because the particulate mixture comprises particles of small and larger sizes included in a granulometric range from 0.5 to 3 mm, preferably from 1 to 3 mm. Thus the small cork particles fill in the gaps created by the presence of particles of larger size. It is this particulate arrangement that leads to a uniform distribution of the cork particles on the first surface. In addition, the protective membrane according to the invention is also fire-resistant since it is sufficiently covered with cork particles and avoids the risk related to the tearing away of said particles on the surface in the event of bad weather for example since the surface is sufficiently smooth.

The steam heat treatment of the cork particles results in obtaining hydrophobic particles. This treatment enlarges the hydrophobic pores of the cork particles so that the cork no longer absorbs through its hydrophilic pores. It should be noted that the steam heat treatment that is used targets the intrinsic structure of the cork particles. The distribution of the cork particles that have been heat treated with steam on the first surface of the protective membrane leads to the formation of a hydrophobic surface. Said treatment prevents the formation of microorganisms or algae on the surface.

The entire advantage of using cork particles having a granulometry of between 0.5 and 3 mm, preferably 1 and 3 mm, and which have been heat treated with steam, will therefore be understood, since the combination of these two elements leads to obtaining a durable, watertight, fire-resistant and attractive protective membrane.

In a first preferential embodiment, the protective membrane according to the invention is characterised in that the membrane body comprises cork particles that have a granulometry of between 60 and 500 μm, preferably between 63 and 125 μm.

A mineral bituminous mass consists of approximately 60% oil. Oil is a constituent of the bituminous binder that is present in the protective membrane and contributes to the viscosity required in the membrane. It is therefore necessary to respect a viscosity range of the bituminous binder in order to contain the oil in the crystalline zone of the bituminous mass. Cork absorbs oil since it is a porous material. It is therefore necessary to prevent the use of cork particles and their ability to absorb oil from affecting the viscosity of the protective membrane. This is because the use of cork particles having a granulometry greater than 500 μm in the membrane body causes the appearance of large particles on the surface of the bituminous mixture and therefore a migration of oil towards the surface. In addition, these particles then constitute weak points in the structure of the bituminous binder. This considerably impairs the quality of the end product and its durability. Moreover, the use of cork particles having a granulometry of less than 60 μm is also inadequate. This is because said cork particles, in the form of powder, are not correctly distributed in the bituminous mass, which then lacks coherence. Thus said particles absorb the oil that should remain in the bituminous mass in order to avoid obtaining a viscous bituminous binder. Consequently, the cork particles do not adhere sufficiently to the bitumen binder. However, the cork particles must adhere to the bitumen mass sufficiently in order to obtain a coherent bituminous binder in which the oil remains in the crystalline phase of said binder. The presence of cork particles that have a granulometry of less than 60 μm in the membrane body leads to a viscous product and one that therefore does not conform to the quality sought. When the cork particles have a granulometry of between 60 and 500 μm, preferably between 63 and 125 μm, the aforementioned problems do not appear. This is because the granulometric range chosen comprises cork particles that adhere sufficiently to the bitumen mass without absorbing such a quantity of oil that could make the bituminous binder viscous.

This embodiment, which uses cork particles that have a granulometry of between 60 and 500 μm, preferably between 63 and 125 μm, procures a waterproofing membrane that is lightened compared with the mineral fillers normally used and does not affect the quality, durability and viscosity of said membrane.

In another embodiment, a protective membrane according to the invention is characterised in that, on the second surface, cork particles are distributed that have a granulometry of between 60 and 500 μm, preferably between 63 and 125 μm.

The advantage of using said cork particles on the second surface consists of providing a lighter protective membrane. This is because the cork particles replace the mineral layer normally used, talc, in order to avoid sticking when the membrane is coiled up. The second surface may also be referred to as the bottom surface. Another subject matter of the invention is a method for manufacturing a protective membrane comprising a step in which a framework is impregnated with mineral or vegetable bitumen. A second step consisting of distributing, on the first surface, cork particles, heat treated with steam, which have a granulometry of between 0.5 and 3 mm, preferably between 1 and 3 mm.

The manufacturing method according to the invention may also comprise a step in which the bitumen, mineral or vegetable, is mixed, prior to the impregnation of the framework, with cork particles having a granulometry of between 60 and 500 μm, preferably between 63 and 125 μm.

The method according to the invention also comprises a step that consists of distributing cork particles having a granulometry of between 60 and 500 μm, preferably between 63 and 125 μm, on the bottom surface.

The features, details and advantages of the invention will emerge from the description and drawing given below, non-limitatively. In the drawing, FIG. 1 illustrates the method according to the invention.

A known protective membrane comprises a membrane body, and a first and second surface situated on either side of said membrane body. It should be noted that the first surface may be called the top surface and the second surface may be called the bottom surface. The membrane body comprises a mineral or vegetable bituminous binder. According to the usual embodiment of the manufacturing method, a framework (for example a glass and/or polyester sheet) is immersed in said bituminous binder. After impregnation of the framework with said bituminous binder, the protective membrane is calendered in order to obtain a smooth product. The product then obtained is uniform. After winding of the protective membrane, the latter is in the form of a roll.

According to a first embodiment of the invention, the first surface of a protective membrane comprises cork particles that have a granulometry of between 0.5 and 3 mm, preferably between 1 and 3 mm. Therefore, after impregnation of the framework 1 with bitumen 2 (FIG. 1), the cork particles, previously heat treated with steam, are distributed by means of a hopper 3, for example, on the first surface when the bitumen is still hot (180° C.). Finally, said membrane is calendered preferably twice in order to make the cork particles adhere better to the surface of the membrane. By means of this calendering step, the cork particles adhere more to the top surface of the membrane. The product obtained is then uniform, fire-resistant and durable.

It should be noted that the method for manufacturing a protective membrane involves a step of distributing the cork particles. To do this, a hopper is used for example that is situated above the protective membrane and the flow rate associated with the fall of the cork particles onto the protective membrane is adjusted according to the speed of passage of the protective membrane under the hopper.

Let us add that the heat treatment by steam of the cork particles may be carried out in advance in the factory or at the place where the protective membrane is produced.

Table 1 comprises the materials used according to the prior art during top surfacing (slate granules and flakes); and according to the invention the cork in two different forms, namely the 1-2 mm cork and the cork heat-treated by steam 0.5-3 mm.

TABLE 1

| | Slate granules | Slate flakes | Cork 1-2 mm | Cork heat-treated with steam 0.5-3 mm | Unit |
|---|---|---|---|---|---|
| Form | granules | flakes | granules | granules | / |
| Weight per $m^2$ | 1.6 | 1.2 | 0.3 | 0.4 | $kg/m^2$ |
| Coverage | + | ++ | −− | + | / |
| Calendering | 1 | 1 | 1 | 2 | RLX passage |
| Broof-T2 | 45 | 42 | / | 35 | cm |
| Passing at 3 mm | 99 | 100 | 100 | 100 | % |
| Passing at 2 mm | 95 | 100 | 100 | 71 | % |
| Passing at 1.25 mm | 75 | 88 | 32 | 56 | % |
| Passing at 1 mm | 54 | 68 | 5 | 47 | % |
| Passing 0.5 mm | 35 | 2 | 0 | 15 | % |

Table 1 makes it possible to compare various parameters: the form, the weight per $m^2$, the coverage, the calendering, the flame test and the broof-T2; and the fines that pass at 3 mm, 2 mm, 1.25 mm, 1 mm and 0.5 mm.

The form of the cork granules is spherical and that of the slate flakes is flat. The cork granules have the same form as the slate granulates.

The weight per $m^2$ ($kg/m^2$) is 1.6 $kg/m^2$ for the slate granules, 1.2 $kg/m^2$ for the slate flakes, 0.3 $kg/m^2$ for the cork (1-2 mm) and 0.4 $kg/m^2$ for the cork heat-treated with steam. It is therefore found that 0.4 kg of cork heat-treated with steam suffices to cover 1 $m^2$, unlike the slate granules, which require 1.6 kg of granules to cover the same surface for example.

The coverage represents the distribution of cork particles on the protective membrane. It will be noted that the slate granules or flakes have, through their nature, good granulometric distribution. On the other hand, cork requires the selection of a specific granulometric range. Table 1 compares the coverage of the top surface of a protective membrane comprising cork particles of between 1 and 2 mm and between 0.5 and 3 mm. It will be noted that the use of cork particles having a granulometry between 1 and 2 mm involves a coverage of less quality. This is because the range is then too restricted, which does not lead to a mixture of sufficiently small and large particles at the same time in order to obtain a uniform distribution over the top surface. It is consequently necessary to select a broadened granulometric range in order to obtain a better granulometric distribution on the surface. This is because the particulate arrangement is sufficient when the cork particles have a granulometry of between 0.5 and 3 mm, preferably between 1 and 3 mm. The distribution of said cork particles confers a uniform coverage on the membrane during the top surfacing.

Calendering (4 and 5) consists of smoothing the membrane in order to avoid obtaining a membrane with surface irregularities using preferably each time two rollers juxtaposed on either side of said membrane and placed one after the other. Calendering makes it possible to obtain a smooth waterproofing membrane. It is found that only one calendering is necessary for the mineral fillers normally used (slate granules and flakes), given that the fillers are aided by gravity. The heavy mineral fillers therefore adhere more easily in the binder. On the other hand, the use of cork particles on the surface preferably involves double calendering. This is because said particles adhere less easily to the bituminous binder since the density of the cork is less than the mineral fillers normally used.

Broof-T2 is a flame test for the waterproofing membrane consisting of measuring the propagation of the flame generated under an air flow. It should be noted that there exist many other flame tests. This flame test may vary from one country to another. However, in all cases, these tests assess the fire resistance of the material considered according to pre-established standards. It is found that the use of cork particles that have a granulometry of between 1 and 2 mm on the first surface confers insufficient fire resistance on the protective membrane. This is because this granulometric range does not comprise sufficient particles of different sizes to cover the first surface sufficiently. Consequently the presence of said particles creates spaces during their distribution on the protective membrane and leads to exposing part of the bituminous binder to flame. This then assists the propagation of the flame. However, when cork particles are distributed that have a broadened granulometric range, that is to say between 0.5 and 3 mm, use is made of a particulate mixture comprising more particles of different sizes and therefore the arrangement between the particles is sufficient to cover the membrane uniformly. Consequently the protective membrane thus obtained has better fire resistance since the first surface is uniformly covered.

Another advantage of this embodiment relates to the heat treatment by steam of the cork particles that have a granulometry of between 0.5 and 3 mm, preferably 1 and 3 mm. This technique is based on two steps. First of all, the cork particles are reduced in the form of granules. Next the latter are heat treated with steam. The technique consists in concrete terms of placing the cork granules in an autoclave oven, preferably at high temperature (300°-360° C.). This has the effect of causing the expansion of said particles, which expand and in the end agglomerate. This process provides hydrophobic cork granules. Because of the heat treatment with steam, the cork particles no longer absorb water. The presence of the hydrophobic cork particles on the top surface of the protective membrane therefore prevents the formation of microorganisms or algae on the surface.

In another preferential embodiment, the bituminous mass is mixed with cork particles that have a granulometry of between 60 and 500 μm, preferably between 63 and 125 μm. Next, after the step of impregnating the framework with bitumen, the cork particles previously heat treated with steam, which have a granulometry of between 0.5 and 3 mm, preferably 1 and 3 mm, are distributed by means of a hopper on the first surface when the bitumen is still hot (180° C.).

This embodiment targets the cork particles present in the membrane body. It should be noted that this embodiment can be executed without having the presence of cork particles on the top surface. It is then possible to obtain a protective membrane with cork particles only in the bituminous mass.

TABLE 2

| | Particles <60 μm | Particles lying between 63 and 500 μm |
|---|---|---|
| Viscosity at 180° C. (mPa · s) | 21000 | 14000 |
| Flexibility cold (° C.) | −12 | −20 |
| Penetrability (dmm) | 76 | 110 |

Table 2 compares the viscosity of the bituminous binder at 180° C. (mPa·s), the flexibility cold of the protective membrane (° C.) and the penetrability of said membrane (dmm) when cork particles are used, in the bitumen mass, that have a distribution less than 60 μm and cork particles that have a distribution of between 63 and 500 μm. Note that the latter distribution has the characteristics required with a view to obtaining a protective membrane that is durable, of quality and non-viscous.

It should be noted that the use of cork particles of less than 60 μm in the bitumen mass leads to the obtaining of a protective membrane that has a viscosity of 21,000 mPa·s. This value is greater than that obtained for a membrane comprising cork particles selected between 63 and 500 μm (14,000 mPa·s). This demonstrates once again the importance of having recourse to cork particles that have a granulometry of between 60 and 500 μm in order to avoid obtaining a viscous bituminous binder. The same thing is noted for values of flexibility cold and penetrability, which do not tend towards the values corresponding to the obtaining of an end product that is of quality, durable and non-viscous.

TABLE 3

| | Chalk | Colemanite | Cork | Units |
|---|---|---|---|---|
| Passing at 500 μm | 100 | 100 | 100 | % |
| Passing at 125 μm | 99 | 99 | 100 | % |
| Passing at 63 μm | 94 | 94 | 1 | % |
| Mean grain X50 | 6.04 | 7.2 | 75 | μm |
| Absorption of oil | 25-30 | 30-35 | 600-700 | % |

Table 3 makes a comparison between cork and the two mineral fillers (chalk and colemanite) normally used with the mineral or vegetable bituminous mass. Note that the use of chalk or colemanite with a mass of mineral or vegetable bitumen is known but not the use of cork as a filler in the mineral or vegetable bituminous mass. It should be added that the mineral fillers normally used have a higher density compared with cork. For example, chalk (2700 kg/m$^3$) has a higher density than cork (230 kg/m$^3$).

Table 3 compares parameters for said various materials: fines passing at 63 μm, 125 μm and 500 μm; the median diameter (X 50) and the oil-absorbing capacity of each material expressed as a percentage by weight.

According to the passing dimension used (63 μm, 125 μm and 500 μm), a very precise granulometry is targeted. This is because the percentage expressed represents the passage of the particles through the sieves. Therefore passing at 500 μm allows all the particles to pass that have at least one granulometry of 500 μm. It will be noted that, for the three materials, the passage is 100% and therefore all the particles pass through the sieve. Almost the same thing is found for the second passing dimension. On the other hand, the passing dimension of 63 μm allows practically no more cork particles to pass. This makes it possible to select the cork particles according to the required granulometry.

The median diameter corresponds to passage of half of the particles through the sieve and targets the medium grains. This makes it possible to have information on the average dimension of the cork particles.

The absorption of oil by the filler used corresponds to the quantity of standardised linseed oil that a mass of filler can absorb until it reaches saturation of the material and therefore a paste is obtained. It is found that this parameter is very significant for cork (600-700% by weight) compared with chalk (25-30% by weight) and colemanite (30-35% by weight). The use of cork can however not affect the viscosity of the membrane, in which case the impregnation step may be problematic because of the lack of coherence of the bituminous binder. Consequently it is necessary for the oil to remain in the crystalline zone of the bituminous binder in order to obtain a quality protective membrane that is durable. The granulometry therefore fulfils an essential role in the production of said membrane where the filler consists of cork. This is why the cork particles included in the membrane body must have a granulometry between 60 and 500 μm, preferably between 63 and 125 μm.

In another advantageous embodiment, the first surface of a protective membrane comprises cork particles that have a granulometry of between 0.5 and 3 mm, preferably between 1 and 3 mm. Next the cork particles having a granulometry of between 60 and 500 μm, preferably between 63 and 125 μm, are distributed on the second surface. Finally, said membrane is calendered twice.

TABLE 4

| | Talc | Cork (MF7) | Unit |
|---|---|---|---|
| Passing at 500 μm | 99 | 80 | % |
| Passing at 250 μm | 42 | 45 | % |
| Passing at 125 μm | 24 | 20 | % |
| Passing at 63 μm | 2 | 5 | % |

Table 4 compares several passing sizes (500, 250, 125 and 63 μm) for talc and cork.

Normally talc is used as a mineral filler in order to be able to coil the membrane in the form of a roll and to prevent this surface remaining sticky. Replacing talc with cork confers the same effect. In addition, the use of cork makes it possible to produce a lighter membrane without having to store two materials of different natures.

On the basis of these three embodiments, all possible combinations can easily be imagined. It is therefore possible to have cork on the top surface in combination with cork in the mass and/or on the bottom surface.

The invention claimed is:

1. A protective membrane, useful in waterproofing and noise insulation, comprising a membrane body having first and second surfaces on opposing sides thereon, wherein the membrane body comprises a bituminous mass containing cork particles having a granulometry distribution between 60 and 500 μm, wherein the first surface has a uniform smooth covering of uniformly distributed hydrophobic cork particles having a granulometry distribution between 0.5 and 3 mm, and wherein the second surface has a covering of uniformly distributed cork particles having a granulometry distribution between 60 and 500 μm.

2. The protective membrane of claim 1, wherein the hydrophobic cork particles covering the first surface have a granulometry distribution between 1 and 3 mm.

3. The protective membrane according to claim 1, wherein the cork particles contained in the membrane body have a granulometry distribution between 63 and 125 μm, and wherein the cork particles covering the second surface have a granulometry distribution between 63 and 125 μm.

4. The protective membrane according to claim 2, wherein the cork particles covering the second surface have a granulometry distribution between 63 and 125 μm, and wherein the cork particles contained in the membrane have a granulometry distribution between 63 and 125 μm.

5. A method for manufacturing a protective membrane comprising the steps of impregnating a framework with bitumen and cork particles having a granulometry distribution between 60 and 500 μm to form a membrane body having first and second surfaces on opposing sides thereon, uniformly distributing on the first surface hydrophobic cork particles having a granulometry distribution between 0.5 and 3 mm, and uniformly distributing on the second surface cork particles having a granulometry distribution between 60 and 500 μm.

6. The method according to claim 5, wherein the hydrophobic cork particles distributed on the first surface have a granulometry distribution between 1 and 3 mm.

7. The method according to claim 5 further comprising after the distributing on the first surface step the step of double calendering the membrane body having the hydrophobic cork particles uniformly distributed thereon.

8. The method according to claim 5, wherein the cork particles impregnated in the membrane have a granulometry distribution between 63 and 125 μm, and wherein the cork particles distributed on the second surface have a granulometry distribution between 63 and 125 μm.

9. The method according to claim 6, wherein the cork particles distributed on the second surface have a granulometry distribution between 63 and 125 μm, and wherein the cork particles impregnated in the membrane have a granulometry distribution between 63 and 125 μm.

* * * * *